US008950223B1

(12) United States Patent
Joyce

(10) Patent No.: US 8,950,223 B1
(45) Date of Patent: Feb. 10, 2015

(54) PERSONAL LOCK-OUT BOX WITH TIMER

(76) Inventor: Sean T. Joyce, Toronto (CA)

( * ) Notice: Subject to any disclaimer, the term of this patent is extended or adjusted under 35 U.S.C. 154(b) by 0 days.

(21) Appl. No.: 13/351,288

(22) Filed: Jan. 17, 2012

Related U.S. Application Data

(60) Provisional application No. 61/432,665, filed on Jan. 14, 2011.

(51) Int. Cl.
*E05B 65/52* (2006.01)
*E05B 43/00* (2006.01)
*E05B 47/00* (2006.01)

(52) U.S. Cl.
USPC ..... 70/63; 70/30; 70/159; 70/161; 70/162; 70/267; 70/278.1; 70/278.7; 439/134

(58) Field of Classification Search
USPC ..... 70/30, 49, 58, 63, 266–274, 159–162, 70/277, 278.1, 278.7, 279.1; 206/1.5; 439/134
See application file for complete search history.

(56) References Cited

U.S. PATENT DOCUMENTS 3,851,506 A * 12/1974 Simon ..... 70/271
4,057,983 A * 11/1977 Morgan ..... 70/18
4,070,879 A * 1/1978 Thompson ..... 70/20
4,086,795 A * 5/1978 Foster et al. ..... 70/233
4,245,745 A * 1/1981 Verelle et al. ..... 211/8
4,474,116 A * 10/1984 Castenada et al. ..... 109/51
4,488,764 A * 12/1984 Pfenning et al. ..... 439/133
4,573,332 A * 3/1986 Ma ..... 70/30
4,655,061 A 4/1987 Nishikawa et al.
4,667,491 A * 5/1987 Lokken et al. ..... 70/63
4,674,652 A 6/1987 Aten et al.
4,756,171 A * 7/1988 Homar ..... 70/18
4,776,188 A * 10/1988 Dalaba et al. ..... 70/49
5,129,536 A 7/1992 Robinson
5,392,952 A 2/1995 Bowden
5,594,430 A * 1/1997 Cutter et al. ..... 340/5.22
5,595,073 A * 1/1997 Sullivan ..... 70/18
5,701,770 A * 12/1997 Cook et al. ..... 70/63
5,826,715 A * 10/1998 Thompson ..... 206/261
5,979,198 A * 11/1999 Haas-Trober et al. ..... 70/268
6,149,445 A * 11/2000 Daddono ..... 439/133
6,185,964 B1 * 2/2001 Addiego ..... 70/58
6,192,719 B1 * 2/2001 Stukas et al. ..... 70/18
6,523,374 B1 * 2/2003 Owens ..... 70/63
6,604,390 B1 * 8/2003 Nooner ..... 70/63
6,825,753 B2 11/2004 Cardinale et al.
6,843,081 B1 * 1/2005 Painter ..... 70/63
7,086,258 B2 8/2006 Fisher et al.
7,132,925 B2 11/2006 Johnson et al.
7,178,370 B2 * 2/2007 Engel ..... 70/63
7,360,380 B2 * 4/2008 Van Handel ..... 70/63
2002/0157437 A1 * 10/2002 Laurie ..... 70/272
2003/0230124 A1 * 12/2003 Johnson et al. ..... 70/267
2004/0045329 A1 * 3/2004 Farnham et al. ..... 70/63
2004/0083778 A1 * 5/2004 Loeff et al. ..... 70/63
2006/0137413 A1 * 6/2006 Yu ..... 70/63
2007/0180873 A1 8/2007 Yen et al.
2012/0272694 A1 * 11/2012 Abalkhail ..... 70/63

* cited by examiner

*Primary Examiner* — Lloyd Gall
(74) *Attorney, Agent, or Firm* — Robert C. Montgomery; Montgomery Patent & Design

(57) ABSTRACT

A personal lock box with a timer comprising a hinged strong-box with an internal cavity that is large enough to contain small personal items therein. The lock box is controlled by an electronic circuit. The lock box further comprises a user interface, a timer, a power source, and associated circuitry. The user interface allows a user to activate the device, selectively program a locked time, and initiate a locked cycle during which time the lockbox cannot be opened. Additionally, the lock box comprises a retractable locking cord for securing the lock box to large items.

16 Claims, 6 Drawing Sheets

PERSONAL LOCK-OUT BOX WITH TIMER

RELATED APPLICATIONS

The present invention was first described in and claims the benefit of U.S. Provisional Application No. 61/432,665 filed on Jan. 14, 2011, the entire disclosures of which are incorporated herein by reference.

FIELD OF THE INVENTION

The present invention relates generally to a lock-out box, and in particular, to a lock-out box with a timer.

BACKGROUND OF THE INVENTION

Many people use certain items such as cell phones, keys, cigarettes, or similar item too many times throughout a day. So much in fact that these people need a way to cut-off access to these items for certain predetermined amounts of times. Lock-out boxes are known and used to prevent a person from accessing certain items or only accessing the items at certain programmed times.

Daily life is filled with many distractions for all of us. While most of these distractions are necessary to help keep a balance of work and play in our lives, many people may occasionally have the tendency to allow some of these distractions to take control of their lives. Age is typically not a factor in the amount of distraction time, although the items doing the distracting may change over time. Young children may spend an inordinate amount of time in front of the television or computer, while adults may spend too much time doing some online gambling or spending money on credit cards. Accordingly, while self control and realization of one's limits is critical, there exists a need for a means by which physical items that allow for such distractions and which allow for unlimited usage impulses can be controlled.

Various attempts have been made to provide a lock-out box. Examples of these attempts can be seen by reference to several U.S. patents. U.S. Patent No. 2007/0180873, issued in the name of Yen et al., describes a lockable container for securing items.

U.S. Pat. No. 5,129,536, issued in the name of Robinson, describes a sealable food storage container with a timed locking mechanism.

U.S. Pat. No. 6,825,753, issued in the name of Cardinale et al., describes a lockbox having a programmable opening to provide access to the contents at desired times.

While these devices fulfill their respective, particular objectives, each of these references suffer from one (1) or more disadvantages. Many such devices are not suited for items which need charged from a power source. Other devices are too large in size to be transported by a user. Accordingly, there exists a need for a lock-out box without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a lock-out box with timer.

Accordingly, it is an object of the present embodiments of the invention to solve at least one (1) of these problems. The inventor has addressed this need by developing a lock-out box with a timer.

To achieve the above objectives, it is an object of the present invention to provide a lock-out box with timer.

Another object of the present invention is to provide the lock-out box with timer with a housing assembly.

Yet still another object of the present invention is to provide the housing assembly with a hinge, a housing lid, and a housing base.

Yet still another object of the present invention is to provide the housing base with a latching mechanism.

Yet still another object of the present invention is to provide a means to program the time by utilizing an information display and programming buttons.

Yet still another object of the present invention is to provide a first aperture between the housing base and the housing lid to entrap a plug.

Yet still another object of the present invention is to provide a locking cord to secures a target item which is external to the lock-out box.

Yet still another object of the present invention is to provide a power adapter to charge batteries.

Yet still another object of the present invention is to provide an inner space to retain desired items.

Yet still another object of the present invention is to provide a control module to control the lock-out box.

Yet still another object of the present invention is to provide a method of utilizing the device that provides a unique means of using the power adapter to charge the battery, pressing desired programming buttons to activate the lock-out box, placing items within the inner space, closing the lid, programming a period of time during, and restraining the user's access to the locked items.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
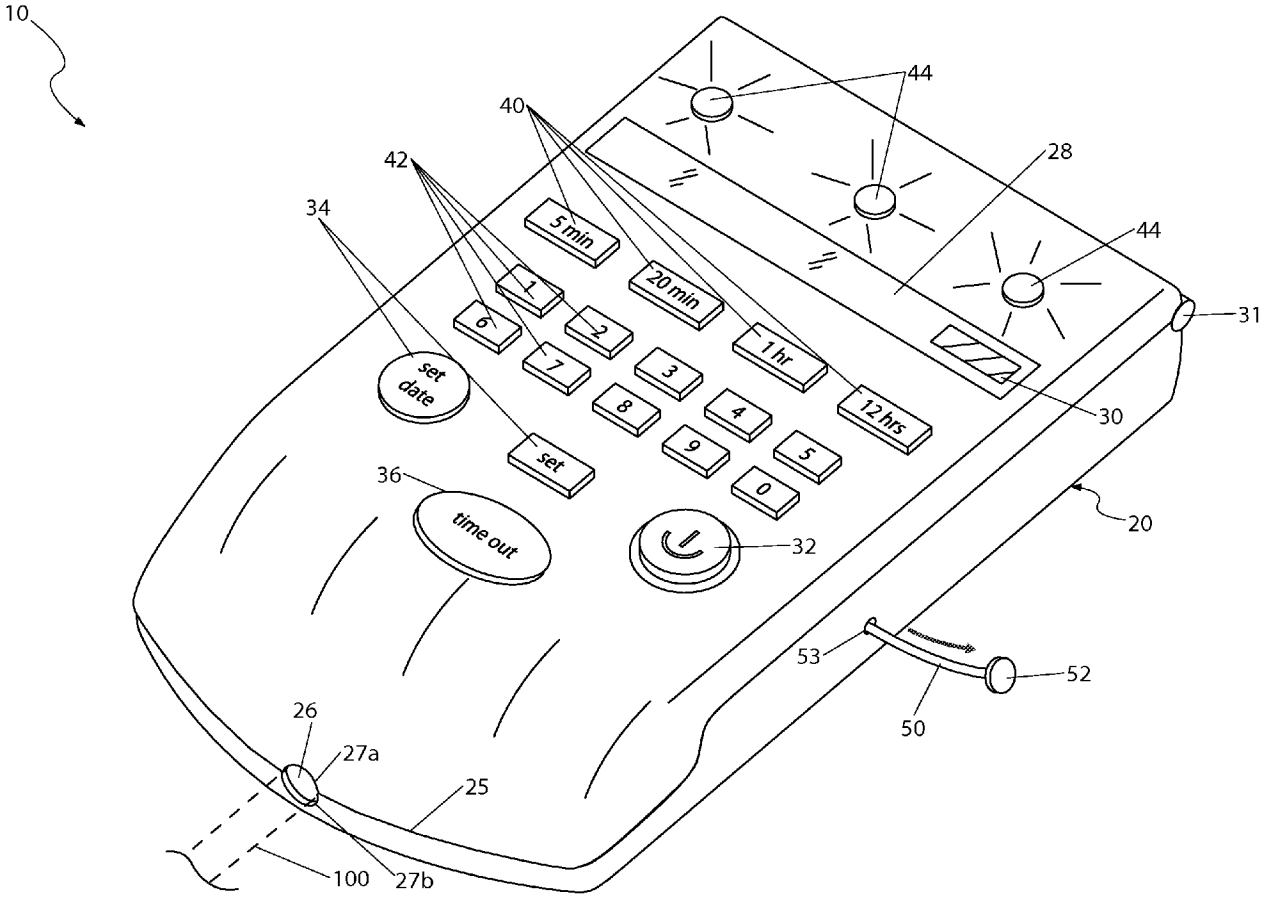
FIG. 1 depicts a right-side perspective view of a personal lock-out box with timer 10 depicted in a closed state, according to a preferred embodiment.

10 personal lock-out box with timer
20 housing assembly
22 housing base

23 battery
24 housing lid
25 solenoid latching mechanism
26 first aperture
27*a* first aperture upper half
27*b* first aperture lower half
28 display
29 control module
30 battery charge indicator
31 hinge
32 power button
34 mode selection button
36 cycle initiation button
40 time period button
42 numeric button
44 indicator lamp
46 second aperture
47*a* second aperture upper half
47*b* second aperture lower half
48 inner space
50 locking cord
52 locking feature
53 third aperture
54 recoil mechanism
60 solenoid
61 shot pin
62 first keeper aperture
63 first post
64 second keeper aperture
65 second post
66 wiring
70 power adapter
72 adapter socket
100 power cord
105 key
110 cell phone

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present disclosure describes the personal lock-out box with timer (herein described as the "device") 10, which provides containment of small items in a locked and inaccessible container for a pre-programmed period of time. The device 10 is preferably suited to reduce distractions and curb impulses. The device 10 includes a clam-shell housing assembly 20 approximately six (6) inches deep, four (4) inches wide, and two (2) inches high. The device 10 is envisioned to be constructed of a durable plastic material which when locked, cannot be opened without damaging the device 10. A digital display 28 and a plurality of keypad buttons upon a housing lid 24 allows a user to electronically program a locked period of time. The device 10 is powered by one (1) or more disposable or rechargeable batteries 23 located within the housing base 22 which can only be accessed through the interior space 48 of the device 10. The construction of the device 10 allows the user to place items within the interior space 48 such as cigarettes, power cords 100, keys 105, cell phones 110, prescription drugs, credit cards, and other items that cause a distraction or temptation.

Referring now to FIG. 1, a right side perspective view of the device 10 depicted in a closed state, is disclosed. The plastic clam-shell housing assembly 20 which comprises a hinge 31 along a rear edge provides a means by which a user may selectively pre-program a period of time electronically, during which the housing lid 24 of the device 10 will be locked against a housing base 22, thereby preventing access to items contained within. The housing base 22 includes a solenoid latching mechanism 25 which when actuated prevents the user from opening the lid (see FIG. 4).

Programming of the locking time is performed with the information display 28 and the plurality of programming buttons 34, 36, 40, 42 incorporated into the housing lid 24. The display 28 is envisioned to be a liquid-crystal-display (LCD) or equivalent technology and is further envisioned to include a bar-graph type battery charge indicator 30 to communicate to the user the remaining life of the internal batteries 23. The programming buttons 34, 36, 40, 42 preferably include, but are not limited to: a plurality of mode selection buttons 34, a cycle initiation button 36, a plurality of time period buttons 40, and a plurality of numeric buttons 42. The housing lid 24 further comprises a plurality of indicator lamps 44 envisioned to be located above the display 28. The mode selection buttons 34 are envisioned to include functions such as "SET DATE", "SET", "ENTER", and the like. The time period buttons 40 are envisioned to indicate selections such as "5 MIN", "20 MIN", "1 HOUR", "12 HOURS", and the like. The indicator lamps 44 are envisioned to communicate status information such as "SET", "TIME OUT", "LOW BATTERY", and the like. Additionally, the housing lid 24 is envisioned to include a power button 32 to electrically activate the aforementioned electronic features.

Figure 2:
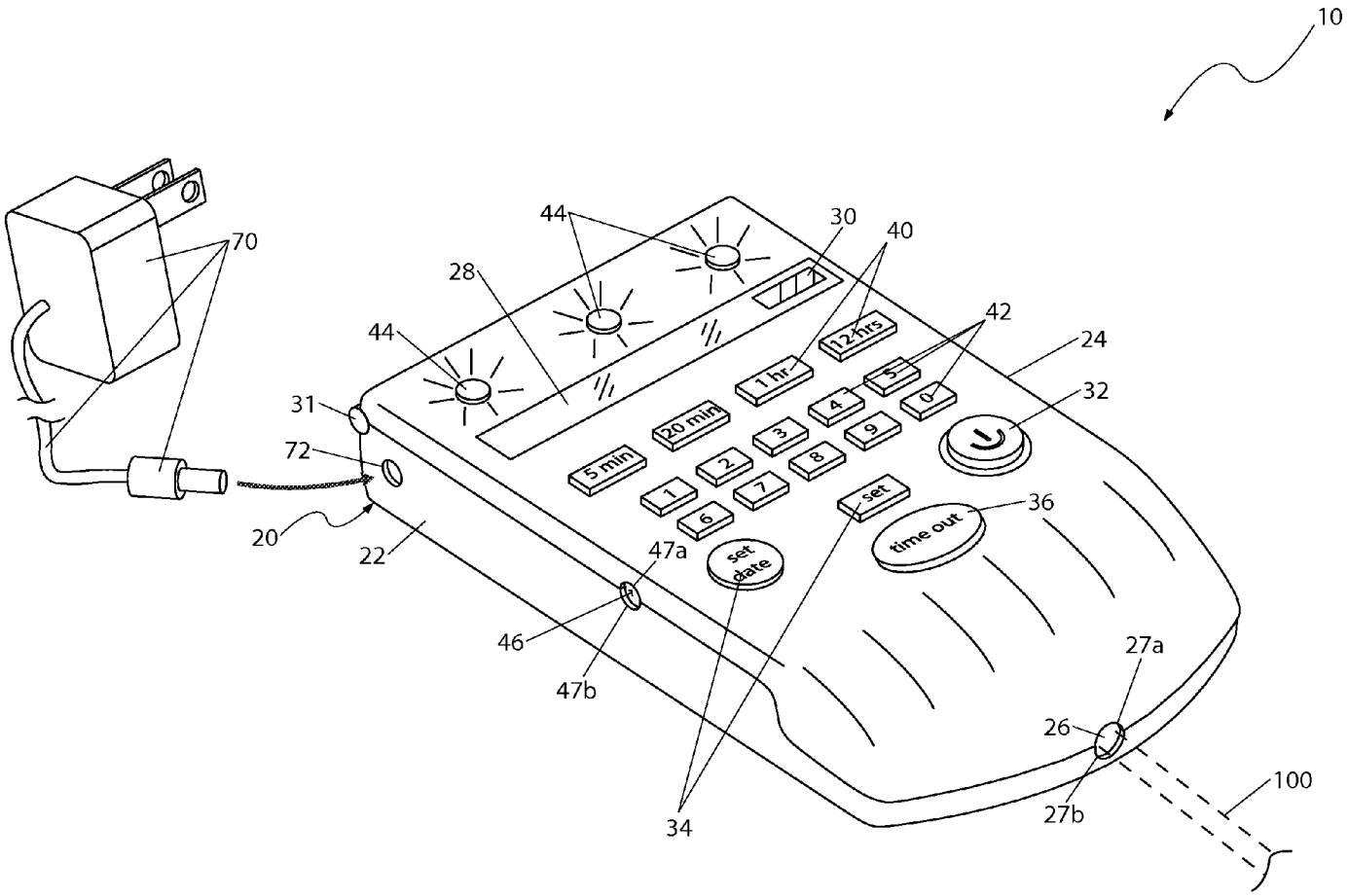
FIG. 2 depicts a left-side perspective view of the personal lock-out box with timer 10 depicted in a closed state, according to a preferred embodiment.

Referring now to FIG. 2, a left side perspective view of the device 10 depicted in a closed state is disclosed. The device 10 includes a first aperture 26 being split in half between the housing base 22 and the housing lid 24 along a forward edge into an upper half 27*a* and a lower half 27*b*, respectively. The first aperture 26 is sized to entrap a plug from a power cord 100 and enabling the cord 100 to be routed therethrough and similarly shaped objects within the device 10. The device 10 further includes a locking cord 50 and a second aperture 46. The locking cord 50 comprises a length of wire-rope which is wrapped around a large target object and secured within a second aperture 46 along an opposite side of the housing assembly 20 (see FIG. 3*b*). The second aperture 46 is divided into an upper half 47*a* and a lower half 47*b* being positioned along a side edge of the housing lid 24 and the housing base 22, respectively, in a similar fashion as the aforementioned first aperture 26 and sized to permit the locking cord 50 to pass through and retain the locking feature 52 within the inner space 48 of the device 10.

The device 10 provides a means of operation which utilizes available alternating current (AC) power as well as provides a means to charge the internal batteries 23 via an AC power adapter 70 being removably attached to the housing base 22 via an integral adapter socket 72 along a side surface. The power adapter 70 is envisioned to comprise a standard AC to DC unit having prong portions which plug into and utilize a standard household electrical outlet in a conventional manner.

Figure 3A:
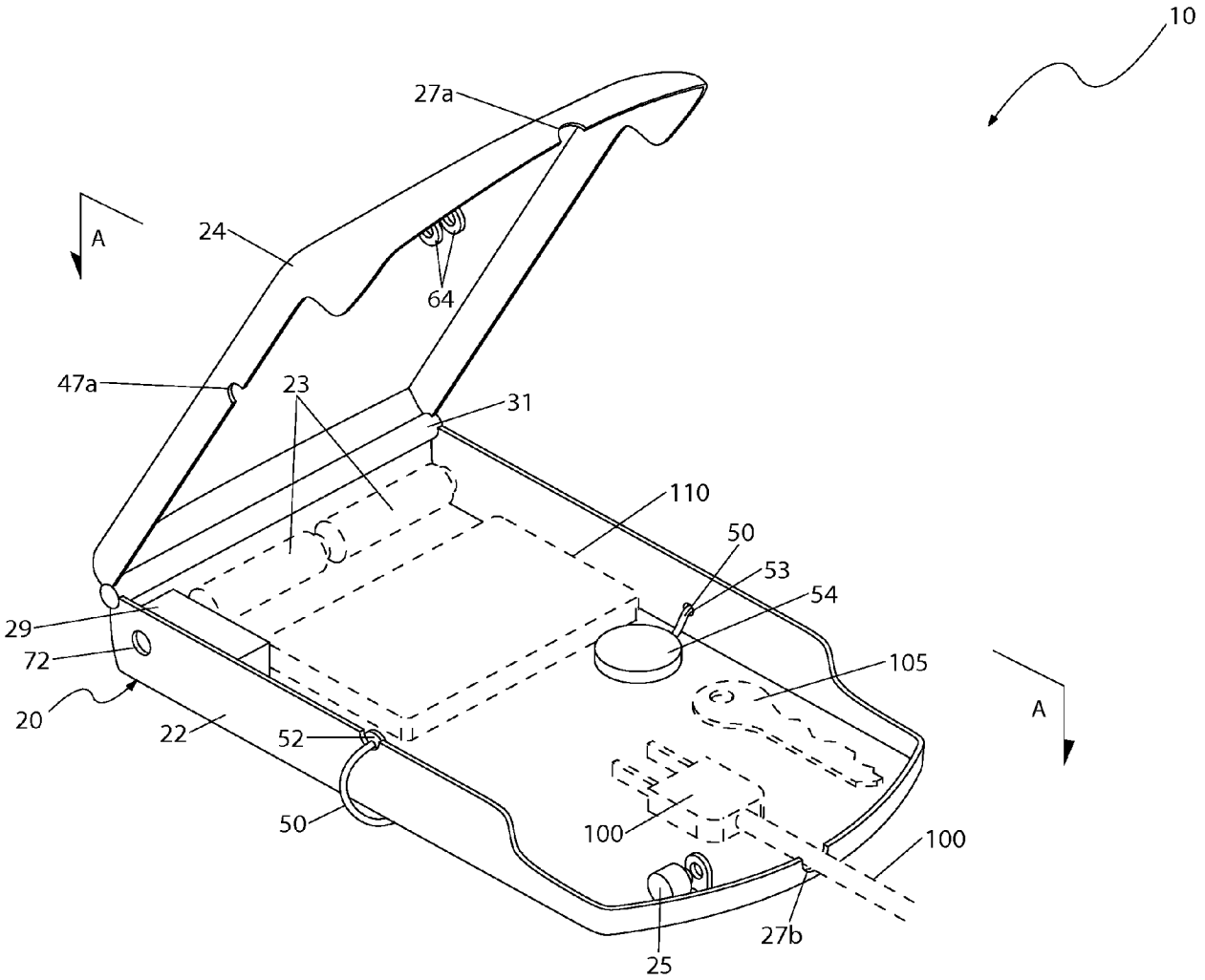
FIG. 3*a* depicts a left-side perspective view of the personal lock-out box with timer 10 depicted in an open state, according to a preferred embodiment.

Referring now to FIG. 3*a*, a left-side perspective view of the device 10 depicted in an open state, is disclosed. The device 10 includes a generally rectangular inner space 48 capable of concealing personal items such as a pack of cigarettes, power cords 100, keys 105, cell phones 110, prescription drugs, credit cards, and other similarly sized items. The first aperture 26 allows the user to extend the power cord 100 through the first aperture 26, thereby entrapping a plug portion of the power cord 100 within the device 10.

The housing base 22 also provides a housing and attachment means to the batteries 23 and a control module 29 along a rearward internal area. Said control module 29 provides microprocessor-based electronic control of the device 10 (see FIG. 5).

Figure 3B:
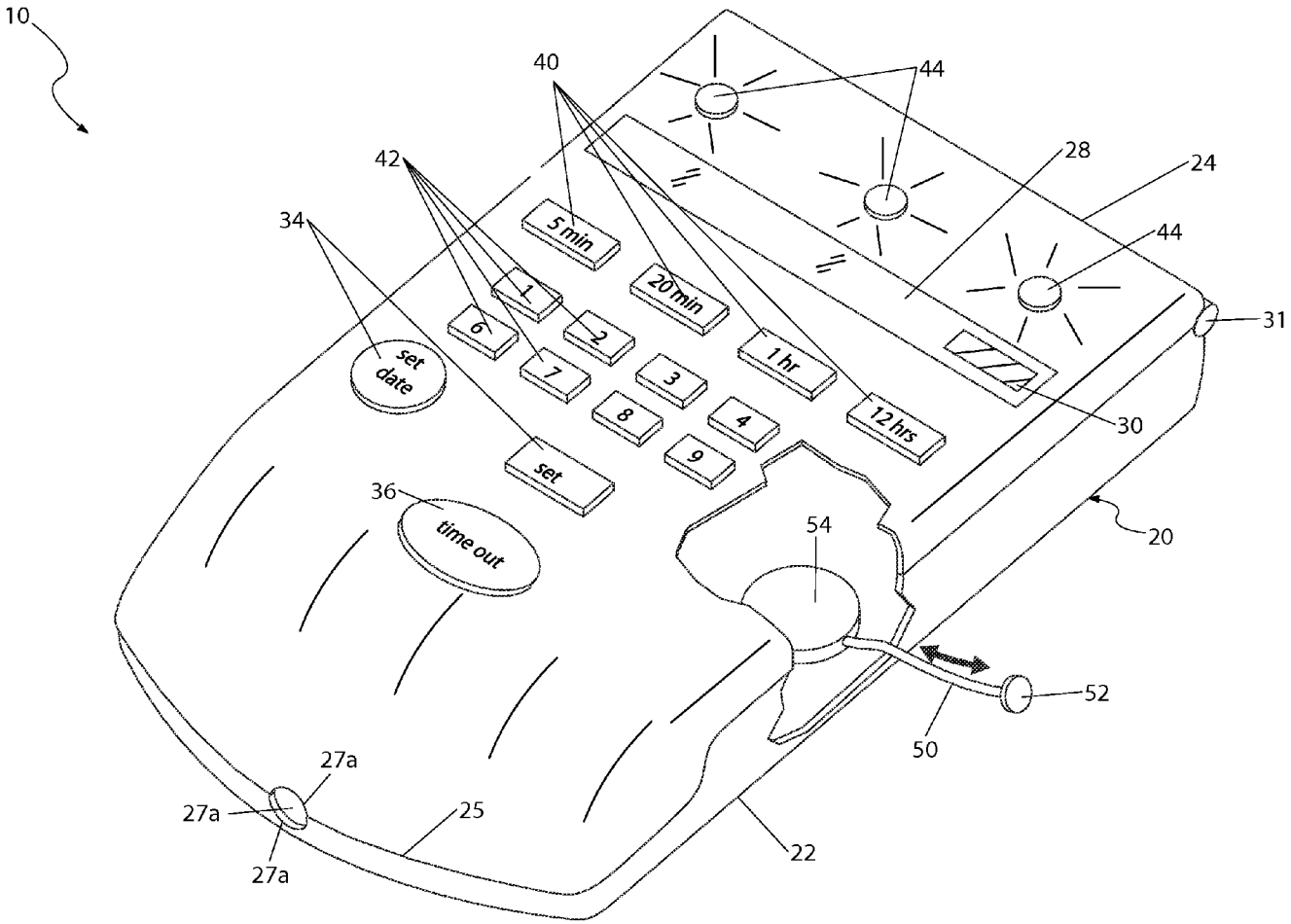
FIG. 3*b* depicts a partial break-away right-side perspective view of the personal lock-out box with timer 10 depicting a recoil mechanism portion 54, according to a preferred embodiment.

Referring now to FIG. 3*b*, a partial break-away right-side perspective view of the device 10 depicting a recoil mechanism portion 54, according to a preferred embodiment, is disclosed. The recoil mechanism 54 is stationarily mounted to an interior surface of the housing base 22 and provides a winding means to collect the locking cord 50 within. The locking cord 50 in turn secures a target object being external to the device 10. The said locking cord 50 works in conjunction with a second aperture 46, a locking feature 52, and a third aperture 53. The locking cord 50 is envisioned to include a length of small diameter wire-rope capable of encompassing objects such as a refrigerator, a drawer, or the like. The locking cord 50 comprises a integral button-shaped locking feature 52 permanently affixed to a free end portion which is extended from the internal recoil mechanism 54; exits the housing base 22 through a third aperture portion 53; wraps around the target object; and is finally secured by entrapping the locking feature 52 within the second aperture 46 along an opposite side of the housing assembly 20. The retracting function of the recoil mechanism 54 and the locking cord 50 allows the user to cinch up an excess length of the locking cord 50 into said recoil mechanism portion 54 of the device 10. Said recoil mechanism 54 is envisioned to be similar to commercially available locking devices made by companies such as PACKRIGHT™, LIFEVENTURE™, and the like.

Figure 4:
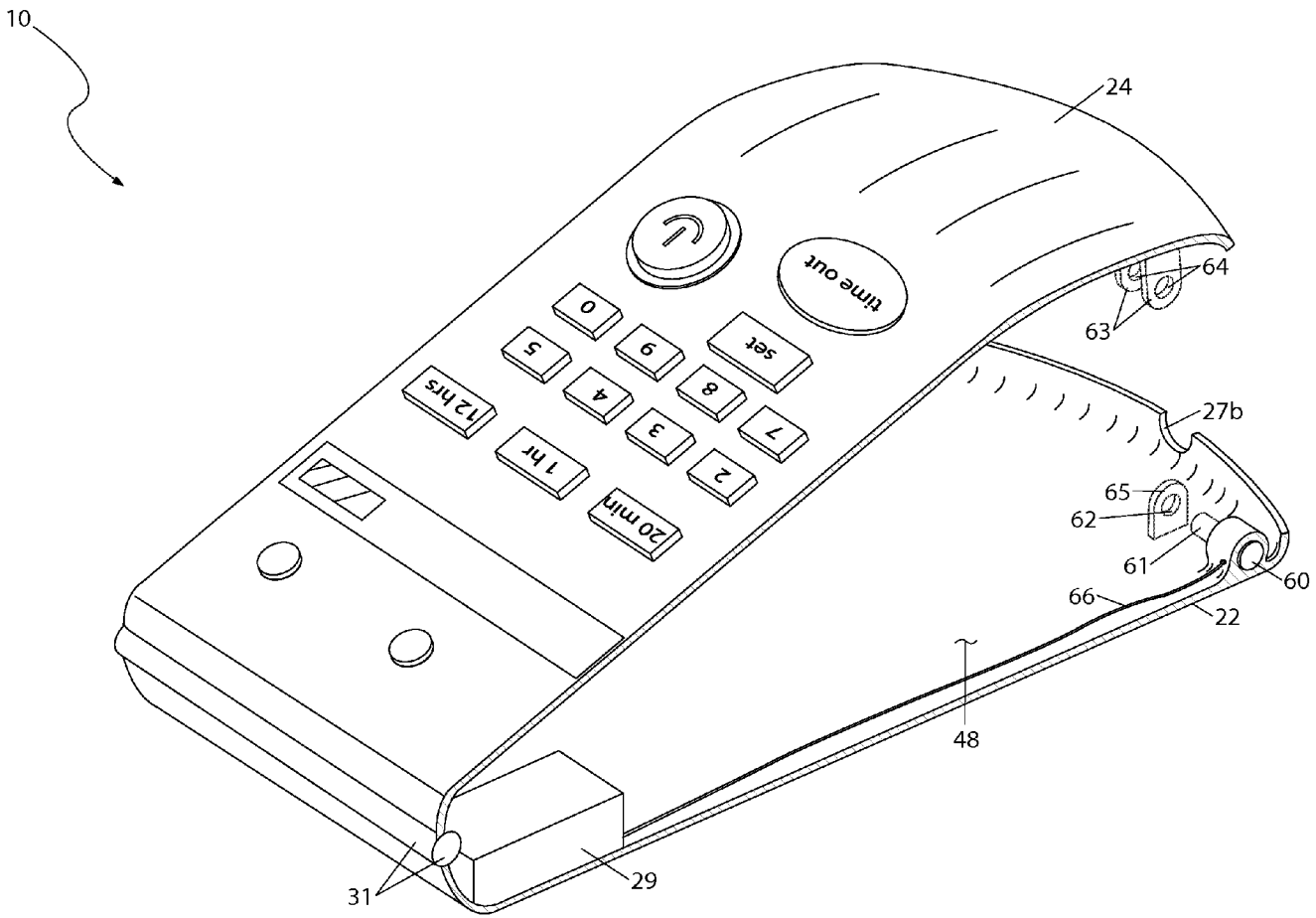
FIG. 4 depicts a left-side section view of a solenoid latching mechanism 25 portion of the personal lock-out box with timer 10 taken along section line A-A (see FIG. 3*a*), according to a preferred embodiment; and, FIG. 5 is an electrical block diagram of the personal lock-out box with timer 10, according to a preferred embodiment.

Referring now to FIG. 4, a left-side section view of a solenoid latching mechanism 25 portion of the device 10 taken along section line A-A (see FIG. 3*a*), according to a preferred embodiment, is disclosed. The solenoid latching mechanism 25 further comprises a solenoid 60, a shot pin 61, a pair of first posts 63, a second post 65, and an electrical wire 66. The solenoid portion 60 of the solenoid latching mechanism 25, when actuated, magnetically motions a spring-return shot pin 61 which is inserted into corresponding first 62 and second 64 keeper apertures of the second post 65 and pair of first posts 63, respectively. Said keeper apertures 62, 64 comprise integrally molded portions of the housing base 22 and housing lid 24, respectively. Said posts 63, 65 comprise appendages with the keeper apertures 62, 64 such that they are aligned with each other and with the shot pin 61 along a common centerline when the housing lid 24 is closed. Said solenoid latching mechanism 25 prevents the user from opening the lid. It is understood that other types of locking mechanisms may be utilized with equal benefit without deviating from the teachings of the invention, and as such should not be interpreted as a limiting factor of the device 10.

Figure 5:
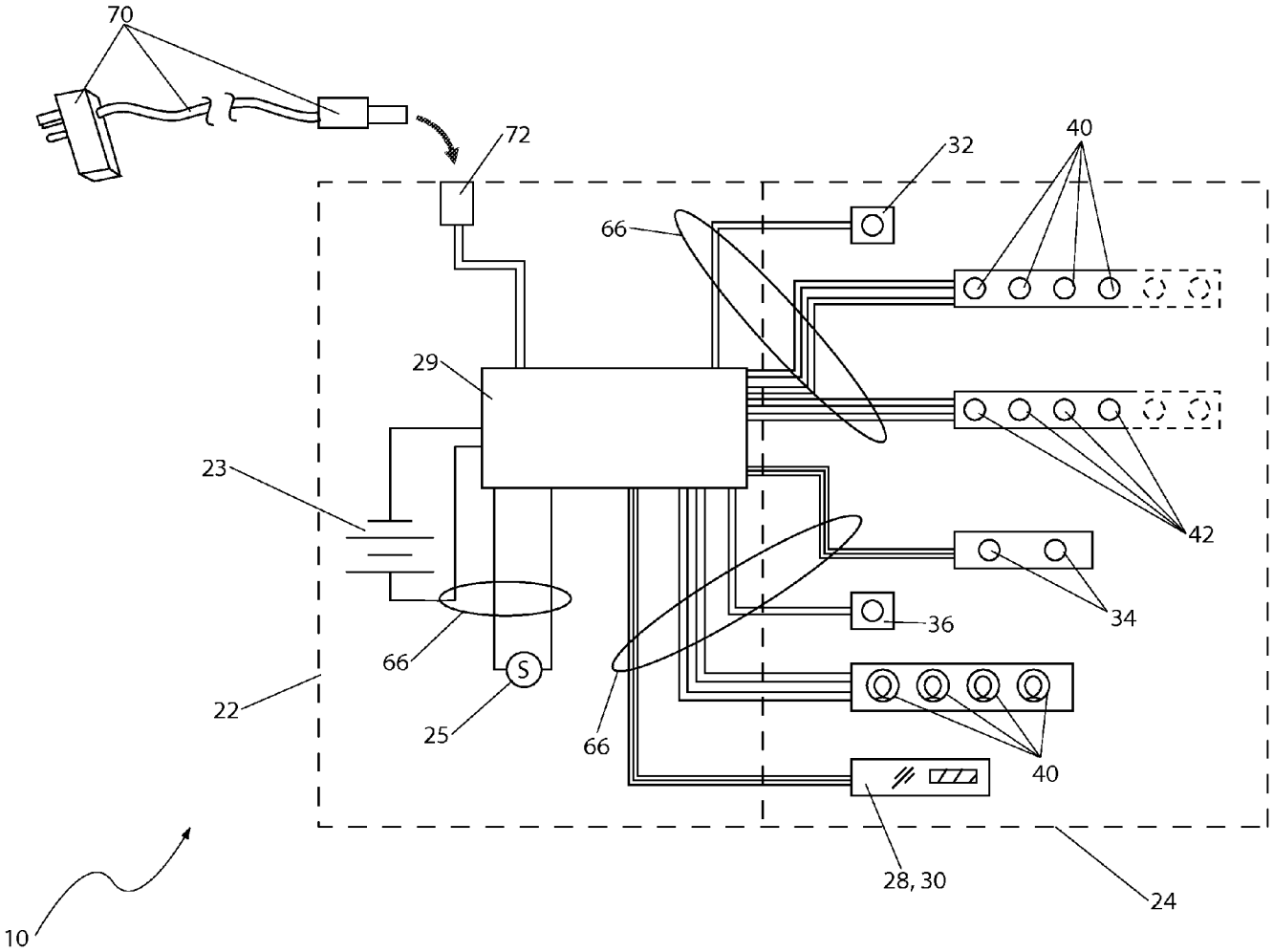

Referring now to FIG. 5, an electrical block diagram of the device 10, according to a preferred embodiment, is disclosed. The device 10 comprises one (1) or more rechargeable or disposable batteries 23 which provide power to the control module 29. The device 10 comprises an AC power adapter 70 which may be utilized to charge said batteries 23 as well as enabling extended operation of the device 10 using available AC power from a standard household electrical outlet. Said control module 29 provides microprocessor-based electronic control of the major components of the device 10 and provides a housing means to electrical and electronic equipment necessary for the operation of the device 10. The control module 29 contains such items as, but is not limited to: a printed circuit board, microprocessors, memory chips, embedded software, I/O circuitry, relays, and the like. The control module 29 is electrically interconnected to the major components of the device 10 via common copper wiring 66. The control module 29 is in electronic communication with the previously described programming and activation buttons 32, 34, 36, 40, 42 to provide programming input signals. Said control module 29 is also in electronic communication with output devices including the display 28, the indicator lamps 44, and the solenoid 60, thereby communicating operational status to the user as well as locking the housing lid portion 24 of the device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIGS. 1 through 4.

The method of utilizing the device 10 can be achieved by performing the following steps: procuring an instance of the device 10; recharging the batteries 23 using the power adapter 70; activating the device 10 by pressing the power button 32; placing items such as power cords 100, keys 105, cell phones 110, or the like within the inner space 48; closing the housing lid 24 about the hinge 31; programming a period of time during which the device 10 will remain locked shut by using the mode selection buttons 34, time period buttons 40, and numeric buttons 42; observing programmed locking time information on the display 28; pressing the cycle initiation button 36 to actuate the solenoid latching mechanism 25 to lock the housing lid 24 and begin the time cycle; restraining the user's access to the locked items 100, 105, 110 during the locking time; and, benefiting from forced restraint from tempting items 100, 105, 110 afforded by the present device 10.

Additional large items such as a refrigerator door, a drawer, and the like can be locked shut using the device 10 by performing the following steps: grasping the locking feature 52 and extending the locking cord 50 outwardly from the third aperture portion 53 of the housing base 22; wrapping the locking cord 50 around or through said large item; securing the locking feature portion 52 of the locking cord 50 into the second aperture 46 prior to closing and locking the housing lid 24; closing the housing lid 24; cinching the locking cord 50 tightly around said large item by allowing any excess locking cord 50 to be retracted into the recoil mechanism 54; and, securing the housing lid 24 and programming a locking time as described above.

The use of the device 10 allows the user to increase their self-control over distractions of daily life in a manner that is quick, easy, and effective.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A programmable lock-out box for preventing unauthorized access to items stored therein, said programmable lock-out box comprising:

a housing assembly including:

a housing base having a third aperture and a first half aperture, said housing assembly further including a housing lid having a second half aperture and which is pivotally coupled to said housing base, wherein said first half aperture mates with said second half aperture to form a second aperture;

a control module located within said housing assembly;

a solenoid latching mechanism located within said housing assembly and communicatively coupled to said control module;

a plurality of programming buttons located on said housing lid and communicatively coupled to said control module for electronically programming a period of time during which said solenoid latching mechanism maintains said housing lid locked to said housing base; and, a locking cord anchored within said housing assembly and having a locking feature at a free end, said locking cord for extending from said third aperture through said second aperture such that said locking feature is retained in said housing assembly.

2. The lock-out box of claim 1, wherein said solenoid latching mechanism is detachably latched to said housing lid and permanently coupled to said housing base.

3. The lock-out box of claim 1, wherein said second aperture is positioned along a side edge of said housing assembly.

4. The lock-out box of claim 1, further comprising a recoil mechanism that cinches up said locking cord.

5. The lock-out box of claim 1, wherein said locking feature is button shaped.

6. The lock-out box of claim 1, wherein said solenoid latching mechanism comprises:

a solenoid;

a shot pin attached to said solenoid;

a plurality of first posts having a plurality of first keeper apertures respectively; and, a second post having a second keeper aperture;

wherein said solenoid is selectively actuated by said control module and thereby magnetically motions said shot pin to linearly exit from said first keeper apertures as well as said second keeper aperture.

7. A programmable lock-out box for preventing unauthorized access to items stored therein, said programmable lock-out box comprising:

a housing assembly including:

a housing base having a half aperture and a housing lid having a half aperture pivotally coupled thereto, wherein said half aperture of said housing base mates with said half aperture of said housing lid to form a first aperture;

a control module located within said housing assembly;

a solenoid latching mechanism located within said housing assembly and communicatively coupled to said control module;

a plurality of programming buttons located on said housing lid and communicatively coupled to said control module for electronically programming a period of time during which said solenoid latching mechanism maintains said housing lid locked to said housing base; and, wherein said first aperture can entrap a power cord plug within said housing assembly.

8. The lock-out box of claim 7, wherein said solenoid latching mechanism is detachably latched to said housing lid and permanently coupled to said housing base.

9. The lock-out box of claim 7, wherein said solenoid latching mechanism comprises:

a solenoid;

a shot pin attached to said solenoid;

a plurality of first posts having a plurality of first keeper apertures respectively; and, a second post having a second keeper aperture;

wherein said solenoid is selectively actuated by said control module and thereby magnetically motions said shot pin to linearly exit from said first keeper apertures as well as said second keeper aperture.

10. A programmable lock-out box for preventing unauthorized access to items stored therein, said programmable lock-out box comprising:

a housing assembly including a housing base having a first half aperture, a second half aperture and a third aperture, said housing assembly further including a housing lid having a fourth half aperture and a fifth half aperture, wherein said housing lid is pivotally coupled to said housing base, wherein said first half aperture mates with said fourth half aperture to form a first aperture when said housing lid pivots onto said housing base, and wherein said second half aperture and said fifth half aperture forms a second aperture when said housing lid pivots onto said housing base;

a control module located within said housing assembly;

a solenoid latching mechanism located within said housing assembly and communicatively coupled to said control module;

a plurality of programming buttons located on said housing lid and communicatively coupled to said control module for electronically programming a period of time during which said solenoid latching mechanism maintains said housing lid locked to said housing base; and, a locking cord anchored within said housing assembly and having a locking feature at a free end, said locking cord for extending from said third aperture through said second aperture such that said locking feature is retained in said housing assembly.

11. The lock-out box of claim 10, wherein said solenoid latching mechanism is detachably latched to said housing lid and permanently coupled to said housing base.

12. The lock-out box of claim 10, wherein said second aperture is positioned along a side edge of said housing assembly.

13. The lock-out box of claim 10, further comprising a recoil mechanism that cinches up said locking cord.

14. The lock-out box of claim 10, wherein said locking feature is button shaped.

15. The lock-out box of claim 10, wherein said solenoid latching mechanism comprises:

a solenoid;

a shot pin attached to said solenoid;

a plurality of first posts having a plurality of first keeper apertures respectively; and, a second post having a second keeper aperture;

wherein said solenoid is selectively actuated by said control module and thereby magnetically motions said shot pin to linearly exit from said first keeper apertures as well as said second keeper aperture.

16. The lock-out box of claim 10, wherein said first aperture can entrap a power cord plug within said housing assembly.

* * * * *